US006192722B1

(12) United States Patent
Galant

(10) Patent No.: US 6,192,722 B1
(45) **Date of Patent: *Feb. 27, 2001**

(54) ANTI-THEFT DEVICE FOR OFFICE EQUIPMENT

(75) Inventor: Steve N. Galant, Mississauga (CA)

(73) Assignee: CNC Atlas Manufacturing Inc., Mississauga (CA)

( * ) Notice: Subject to any disclaimer, the term of this patent is extended or adjusted under 35 U.S.C. 154(b) by 0 days.

This patent is subject to a terminal disclaimer.

(21) Appl. No.: 09/481,522

(22) Filed: Jan. 12, 2000

Related U.S. Application Data

(63) Continuation-in-part of application No. 09/309,491, filed on May 11, 1999.

(51) Int. Cl.[7] ..... E05D 69/00

(52) U.S. Cl. ..... 70/58; 70/62; 248/551

(58) Field of Search ..... 70/14, 18, 19, 70/57, 58, 62, 158, 163, 164, 167–169; 109/50, 52; 312/223.2, 265.5, 265.6; 248/551–553

(56) References Cited

U.S. PATENT DOCUMENTS

| | | |
|---|---|---|
| 3,410,122 | 11/1968 | Moses . |
| 3,734,335 | 5/1973 | Lincoln . |
| 3,965,705 | 6/1976 | Nadler . |
| 4,028,913 | 6/1977 | Falk . |
| 4,031,721 | 6/1977 | Anderson . |
| 4,312,452 | 1/1982 | Waier . |
| 4,495,787 | 1/1985 | Comstock . |
| 4,585,202 | 4/1986 | Parsekian . |
| 4,696,449 | 9/1987 | Woo et al. . |
| 4,818,986 | 4/1989 | Bauman . |
| 4,843,848 | 7/1989 | Igelmund . |
| 5,052,198 | 10/1991 | Watts . |
| 5,052,199 | 10/1991 | Derman . |
| 5,052,651 | 10/1991 | Guddee . |
| 5,076,079 | 12/1991 | Monoson et al. . |
| 5,085,395 | 2/1992 | Frater et al. . |
| 5,135,197 | 8/1992 | Kelley et al. . |
| 5,169,114 | 12/1992 | O'Neill . |
| 5,479,341 | 12/1995 | Pihl et al. . |
| 5,488,844 | 2/1996 | Winner . |
| 5,510,955 | 4/1996 | Taesang . |
| 5,582,044 | 12/1996 | Bolich . |
| 5,595,074 | 1/1997 | Munro . |
| 5,642,634 | 7/1997 | Perry . |
| 5,660,451 | 8/1997 | Glynn . |
| 5,816,076 | 10/1998 | Biedermann et al. . |
| 5,826,853 | 10/1998 | Annello et al. . |
| 5,836,183 | 11/1998 | Derman . |
| 5,857,568 | 1/1999 | Speirs . |

*Primary Examiner*—Suzanne Dino Barrett
(74) *Attorney, Agent, or Firm*—Ridout & Maybee; David Greer; Dolly Kao

(57) ABSTRACT

An anti-theft device for securing a computer or office equipment component to a work surface. The device is adjustable for use with different sizes of components, and includes a base having first and second sections that can be moved relative to each other. First and second arms extend from the base to receive the equipment component to be secured therebetween. The device includes a generally U-shaped clamping member having an intermediate restraining bar for engaging the office equipment component and first and second parallel arms extending from the restraining member. The first and second parallel arms of the clamping member are telescopically engaged with the first and second arms, respectively, of the base. Locking means associated with the first parallel arms permit the restraining bar to be selectively locked into one of a number of possible positions relative to the base, wherein the equipment component can be clamped between the base and the restraining bar. The widths of the base and clamp member can be adjusted to correspond to the width of the equipment component, and the length of the base can be adjusted to correspond to the length of the component.

20 Claims, 13 Drawing Sheets

ANTI-THEFT DEVICE FOR OFFICE EQUIPMENT

This application is a continuation-in-part of U.S. patent application Ser. No. 09/309,491 filed May 11, 1999 for an Anti-Theft Device For Office Equipment.

BACKGROUND OF THE INVENTION

The present invention relates to an anti-theft device for securing computer and other types of office equipment devices to a surface, and in particular such a device which is adjustable so that it can be used to secure computer and office equipment devices having a range of different sizes.

A variety of techniques and apparatus have been developed through the years for preventing the unauthorized removal of computer equipment. While a great many security devices have been made available in the past for detering the theft of various types of computer equipment, the high cost and great popularity of current computer equipment requires security devices which provide a higher degree of security while at the same time permitting use with equipment of varying sizes, and furthermore minimizing any inconvenience in using or protecting the equipment and keeping costs within reason.

A number of previously available apparatus have been known to incorporate bracket assemblies for securing computer equipment to a supporting surface. For example, U.S. Pat. No. 5,085,395 issued Feb. 4, 1992 to Frater et al discloses a security apparatus which includes a restraining arrangement that surrounds a portion of the computer equipment to be secured, and is itself secured to a supporting surface by an adhesive. U.S. Pat. No. 4,585,202 issued Apr. 29, 1986 to Parsekian also discloses an anti-theft device having a restraining arrangement which surrounds a portion of the computer equipment and allows it to be secured to a supporting surface. Such devices lack versatility in that the restraining arrangements cannot be adjusted to accommodate computer equipment of different sizes, but rather must be custom built to accommodate the dimensions of the particular piece of computer equipment to be secured.

Various universal type securing systems for use with a wide variety of computer equipment have also been developed, such as for example systems which make use of adhesive pads and steel cables. However, the low cost and flexibility provided by such systems typically comes at the cost of reduced security.

It is therefore desirable to provide a anti-theft device for computer equipment which provides a high degree of security and is adjustable for use with computer equipment of varying sizes within predetermined limits.

SUMMARY OF THE INVENTION

The present invention provides an anti-theft device for computer equipment and other office equipment components which allows such components to be secured to a work surface. This anti-theft device is adjustable to accommodate components of different sizes.

According to one aspect of the invention, there is provided an anti-theft device for securing an office equipment component to a support surface. The anti-theft device comprises a base including first and second base sections movable relative to each other, each having a basal surface for resting on the support surface and an opposite facing surface having a support portion for supporting the office equipment component. A first base arm extends from the first base section in a direction opposite the basal surface of the first base section, and a second base arm extends from the second base section in a direction opposite the basal surface of the second base section such that upon placement of the office equipment component on the support portions the component will be located between said first and second base station arms. The anti-theft device also includes a clamping member for placement over the office equipment component, having an intermediate restraining bar and first and second spaced apart, parallel arms extending from the restraining bar for straddling the office equipment and telescopically engaging the first and second base arms, respectively. One of the first clamping member arm and the first base arm has a plurality of longitudinally spaced engagement surfaces located along a portion of the length thereof, and there is a locking device associated with the other of the first clamping arm and the first base arm engaging the engagement surfaces and preventing the clamping member from being pulled apart from the first base section when the locking device is locked.

BRIEF DESCRIPTION OF THE DRAWINGS

For better understanding of the invention, and to show how the same may be carried into effect, reference will now be made, by way of example, to the accompanying drawings, in which.

DETAILED DESCRIPTION OF THE PREFERRED EMBODIMENTS

Figure 1:
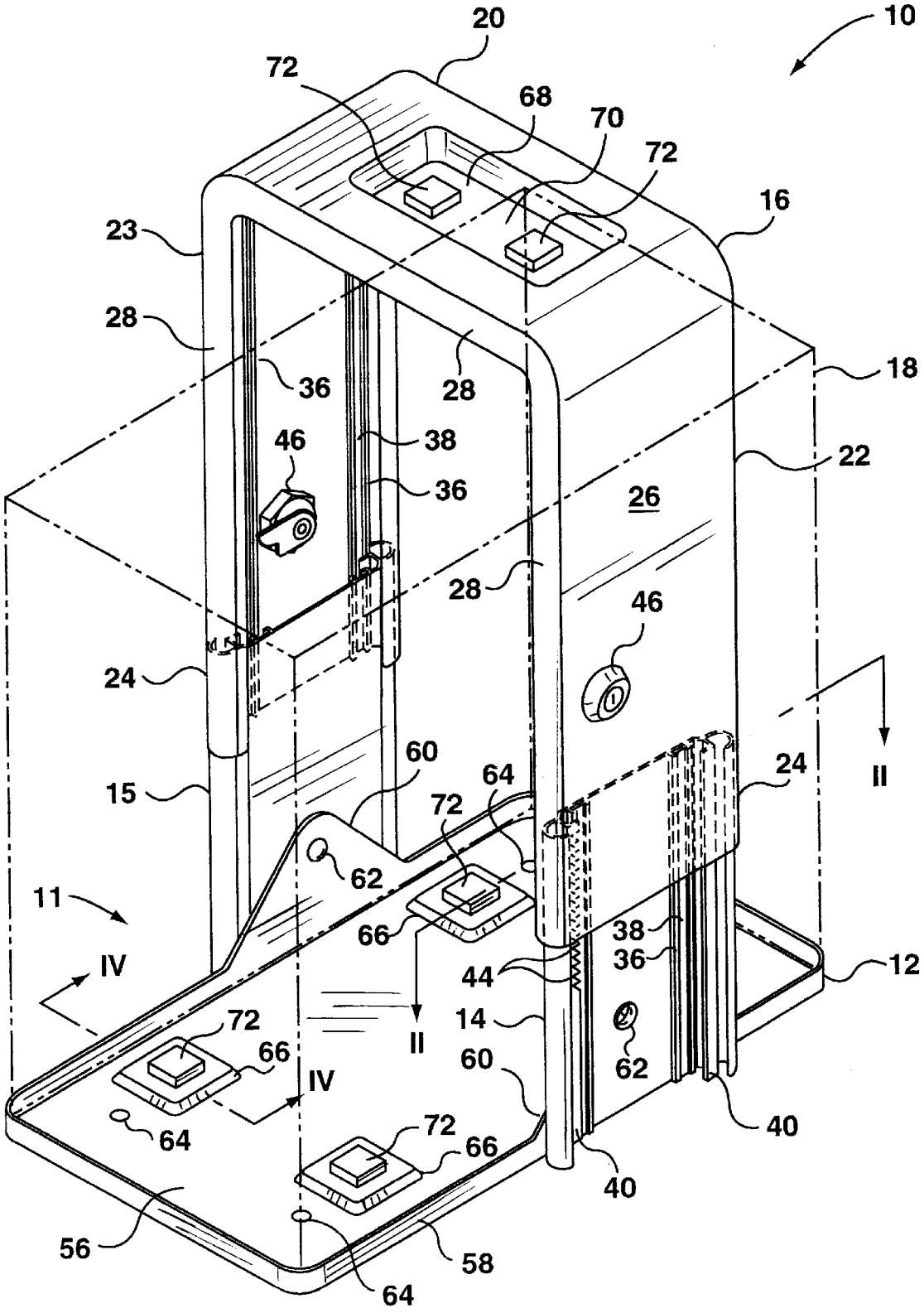
FIG. 1 is a perspective view of the anti-theft device in accordance with one preferred embodiment of the present invention.

FIG. 1 shows an anti-theft device 10 in accordance with a preferred embodiment of the present invention. The anti-theft device 10 includes a substantially U-shaped base member 11 which has an intermediate base frame 12 and first and second parallel arms 14,15. The device further includes a U-shaped clamping member 16 which can be telescopically engaged to base member 11 for securing a computer device (shown by phantom lines 18) to the base frame 12.

The U-shaped clamping member 16 includes an intermediate clamp bar 20 and first and second parallel arms 22,23 which extend orthogonally from opposite ends of the intermediate clamp bar 20. Each of the arms 22,23 has a distal end portion 24 which is configured to be telescopically mounted on an upper distal end of the arms 14,15 respectively, thus enabling the clamping member 16 to be slidably mounted relative to the base frame 12. In particular, with reference to FIG. 2 the first arm member 22 of the clamping member includes a central planar section 26 with two semi-circular flanges 28 running along the opposite side edges of the central portion 26. Similarly first arm 14 of the base member also includes a planar central portion 30 with semi-circular flanges 32 running along the opposite side edges thereof. The arm 14 and arm 22 are sized relative to each other such that when the upper distal end portion of the base member arm 14 is slidably received within the lower distal end portion 24 of the clamping member arm 22, the semi-circular flanges 32 of the base member arm 14 are snugly received within the semicircular flanges 28 of the clamping member arm, thus providing a tight sliding telescopic fit between the two arms. The second arms 15 and 23 are identical to first arms 14 and 22, respectively, and thus any description herein of arms 14 and 22 also applies in respect of arms 15 and 23 unless otherwise noted. Preferably, a number of ribs 34 are provided along the length of semi-circular flanges 28 to provide a contact surface for semi-circular flanges 32 in order to facilitate sliding movement of the clamping member 16 relative to the base member 11.

Figure 2:
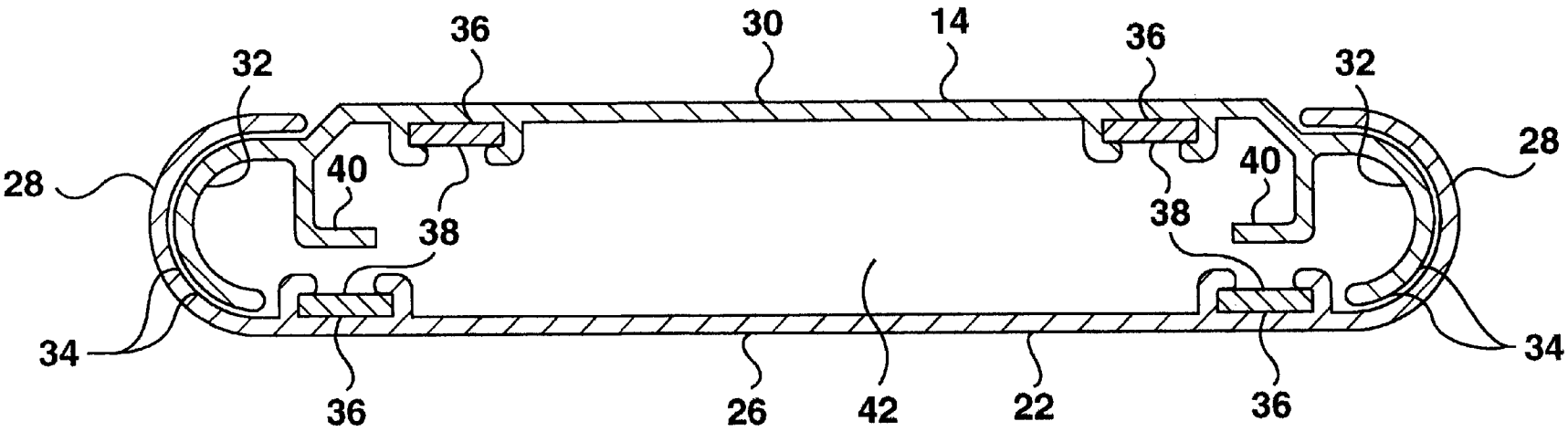
FIG. 2 is a cross sectional view taken along the lines II—II of FIG. 1.
Figure 3:
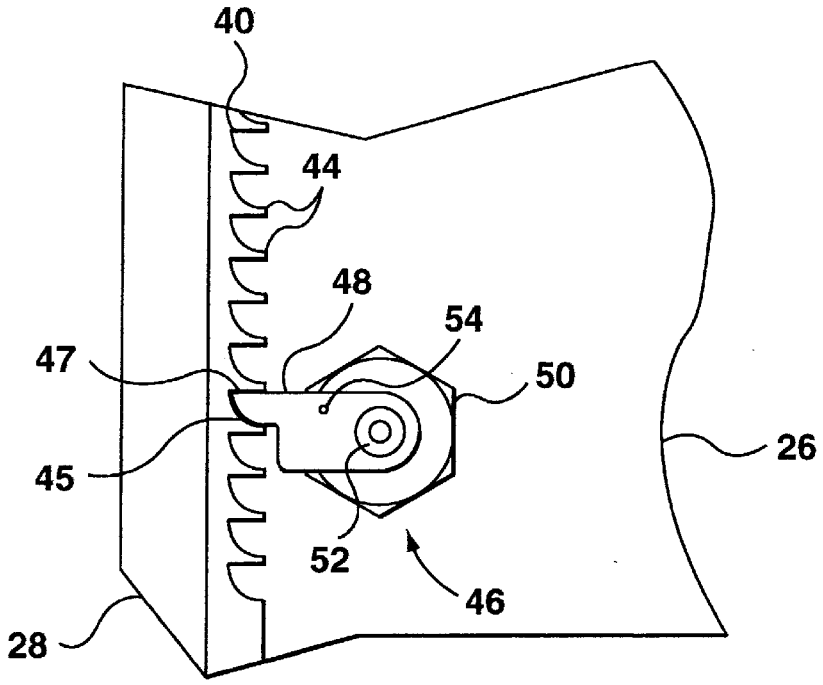
FIG. 3 is a side sectional view showing a rachet locking mechanism of the anti-theft device of FIG. 1.

In the embodiment of the invention illustrated in FIGS. 1–3, the clamping member 16 and base member arms 14,15 are preferably each formed from extruded aluminum, thus providing the anti-theft device with a light weight. The clamping member 16 can be formed from a single piece of extruded aluminum folded at the appropriate places to form intermediate bar and the two parallel arms 22,23. In order to provide additional strength, two parallel channels 36 are preferably provided along the length of the inner surface of the clamping member 16 into which hardened steel strips 38 are placed. Channels 36 are preferably formed along the length of each of the base member arms 14,15 as well for receiving hardened steel strips 38. The presence of the hardened steel strips 38 in the base member arms 14,15 and clamping member arms 22,23 significantly increases the effort required by a potential theif to cut through the clamping member 16 and arms 14,15.

Parallel flanges 40, having an L-shaped cross section, are provided along the length of each of the base member arms 14,15 to further strengthen such arms. As indicated in FIG. 2, the flanges 40 extend into a space 42 that is provided between the base member arm 14 and the clamping member arm 22 when the clamping member 16 telescopically engages base member 11. A number of equally spaced teeth 44 are located along one of the flanges 44 of each of the base member arms 14,15. Furthermore, each of the clamping member arms 22,23 includes a key locking device 46 for selectively engaging one of the teeth 44 to prevent unauthorized removal of the clamping member 16 from the base member 11.

Each locking device 46 is preferably a conventional, commercially available key locking device which extends through a hole provided in its corresponding arm member 22,23. As shown in FIG. 3, such a locking device 46 would preferably include a locking pawl 48 for engaging one of the teeth 44 when the locking device 46 is locked. The locking device 46 includes a retainer nut 50 fastened to the barrel of locking device 46 to hold it in place. The locking pawl 48 is secured to the locking device barrel by means of a retainer screw 52. When the locking device 46 is unlocked, the pawl 48 will be in an unlocked position in which it is pointed downwards, thus enabling the clamping member 16 to be slid along the base frame arms 14,15 away from the base frame 12. When the locking device 46 is locked, the pawl 48 is in a locked position and extends horizontally towards and engages teeth 44, preventing movement of the clamping member 16 away from the base frame 12.

Preferably, teeth 44 and locking device 46 are configured to function as a ratchet assembly, such that the clamping member 16 can be advanced towards, but not retracted from, the base member 11 when the locking device 46 is locked. The teeth 44 are equally spaced cut-outs along the flange 40 which are configured to allow the locking pawl 48 to travel in one direction when the locking device 46 is engaged. The teeth 44 each have a curved lower edge 45 for contacting a lower correspondingly curved edge of the pawl 48, so that the pawl 48 can, when moving in a downward direction, roll up and out of engagement with such teeth. Locking device 46 preferably includes a return spring 54 which allows locking pawl 48 to move up and out of engagement with a tooth 44 and spring back into engagement with the next tooth 44 when the clamping member 16 is being pushed downwards and the locking device 46 is in its engaged position. Each of the teeth 44 has a flat upper edge for engaging an correspondingly flat upper edge 47 of pawl 48. Downward movement of pawl 48 is prevented when locking device 46 is locked, so that in its engaged position the locking device allows the clamping member 16 to be pushed towards the base frame 12, but not extended away from the base frame 12 unless the locking device 46 is unlocked.

With reference to FIG. 1, the base frame 12 preferably includes a substantially planar base plate 56. The dimensions of the base plate 56 correspond to the footprint of the largest computer equipment device that the anti-theft device 10 is intended to be used with. An upwardly extending flange 58 preferably extends around the outer edge of the base plate 56. The parallel base member arms 14,15 are connected to the base frame 12 by means of triangular shaped gusset plates 60 which extend upwards from opposite sides of the base plate 56. A hinge pin 62 is used to connect each of the arms 14,15 to its corresponding gusset plate 60. Preferably, the arms 14,15 are pivotally attached by their respective hinge pins 62 to the base frame 12 so that they can be rotated relative to the base frame 12 in order to facilitate shipping and storage of the anti-theft device 10.

A plurality of securing holes 64 are provided through base plate 56 to allow the base member 11 to be secured to a supporting surface by means of fastening devices such as screws or bolts or ram-set nails and the like. Preferably at least four raised support pads 66 (only three of which are shown in FIG. 1) are provided on the base plate 56 for engaging and supporting the bottom surface of the computer equipment device that is to be secured. The base plate 12 is preferably constructed from a metal material suitable for use with current injection moulding or metal stamping technology.

The intermediate clamp bar 20 preferably includes a centrally located depression 68 which has a planar lower clamp plate portion 70 for engaging an upper surface of the computer equipment device to be secured. The underside of the lower clamp plate portion 70 is preferably located in a plane that is at least as low as any other part of the intermediate clamp bar 20 to ensure that the clamp plate portion 70 comes into contact with the upper surface of the computer equipment device to be secured.

Figure 4:
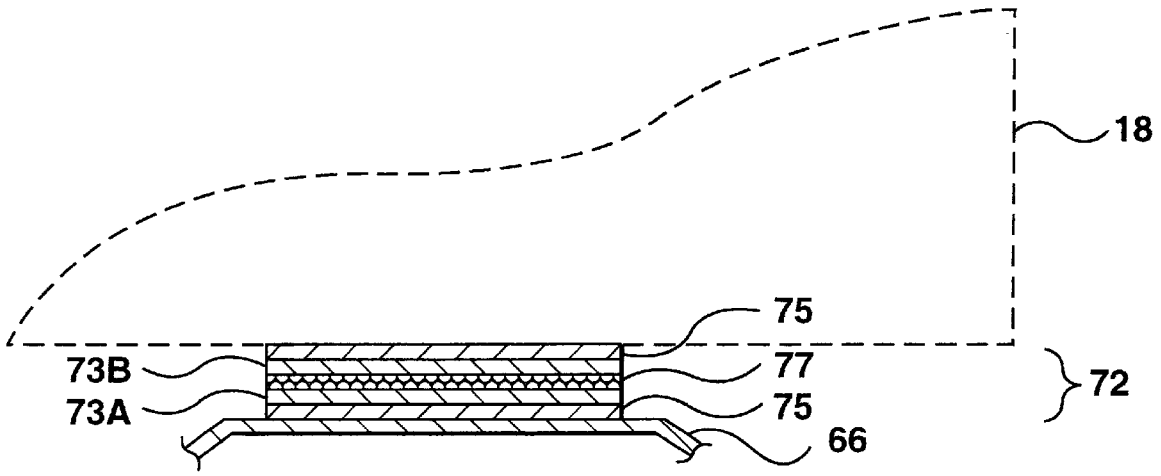
FIG. 4 is a cross-sectional view taken along the lines IV—IV of FIG. 1.

The anti-theft device 10 preferably includes a number of friction enhancing traction pads 72 attached to its computer equipment contacting surfaces in order to prevent lateral motion of secured computer equipment relative to the base frame 12 and intermediate clamp portion 20. In particular, a traction pad 72 is provided on the upper surface of each of the support pads 66, and two traction pads 72 are preferably provided on the underside of lower clamp plate 70. With reference to FIG. 4, each of the traction pads 72 preferably include two halves 73A and 73B, each of which has an adhesive such as double sided tape 75 located on one side thereof and interconnection means 77 located on the other side thereof. One half 73A is secured to the corresponding support pad or clamp plate by means of its double-sided tape 75, and the other half 73B is intended to be secured to a surface of the computer equipment device 18 by means of its double-sided tape 75. The interconnecting material of the two halves 73A and 73B of the traction pad comprise a self-locking material including a plurality of extending parts that when placed face-to-face and compressed together interlocks such that the two halves cannot be separated using lateral force. One commercially available material suitable for use as traction pads in the present invention is 3M #SJ-3551 DUAL LOCK (trade-mark).

Prior to or after sale of the anti-theft device 10, each of the anti-skid pads 72 is secured to its corresponding support surface of the device 10 by peeling the double sided tape from one of the halves while both halves are still attached together, and securing such pads to their corresponding support surfaces. When a computer equipment device is to be secured to the anti-theft device 10, the double sided tape on the other half is then removed so that when the computer equipment device is clamped by the anti-theft device 10, such other halves will become secured to the computer equipment in the appropriate locations.

With references to FIG. 1 through 3, the use and operation of the anti-theft device 10 to secure a computer equipment component will now be described in greater detail. As a first step, the base member arms 14,15 are rotated into an upright position so that they extend orthogonally from base plate 56. The base frame 12 is then secured to a supporting surface by means of bolts or screws, or ram-set nails, placed through securing holes 64. It will be appreciated that other securing means, such as adhesive, could be used in conjunction with such screws or bolts, or on its own, to secure the base frame 12 to a supporting surface. The computer component 18 is then positioned on the base frame 12 between base frame arms 14,15 such that portions of its lower surface rest on the support pads 66. Preferably, one half of each of the four traction pads 72 provided on base frame 12 have been connected to the lower surface of computer device 18 in the appropriate spots for lining up with the complimentary traction pad halves located on support pads 66.

The securing holes 64 are located such that when the computer device 18 is placed on the base frame 12, access to the securing holes 64 is blocked. In this regard, securing holes 64 are preferably off-set from the side edges of the base plate 56 a sufficient distance that they will be covered by computer devices 18 having a variety of different footprint sizes. Support pads 66 are also positioned so that they can support computer devices having a range of different footprint sizes.

Once the computer device 18 is placed on the base frame 12, the clamping member 16 is secured to the base frame 12 by telescopically mounting arms 22,23 to parallel first and second base member arms 14,15 respectively, ensuring the locking devices 46 are in their engaged position, and sliding the clamping member 16 downward towards the base frame 12 until the lower clamping plate 70 comes into contact with the upper surface of the computer device 18. As noted above, locking devices 46 are preferably spring loaded so that they will "ratchet" down along teeth 44 until the clamping member 16 tightly secures the computer device 18 to the base frame 12, at which point the computer device 18 is firmly locked in place. As noted above, traction pads 72 are provided on the lower surface of lower clamp plate 70 to engage the top surface of computer device 18.

When the clamping member 16 is in its locked position, the inner lock mechanisms (such as locking pawl 38 of the locking devices 46, and teeth 44) are concealed in the spaces 42 between the base member arms 14,15 and the clamping member arms 22,23 thus preventing access to such components. Furthermore, once the clamping member 16 is tightly clamped against computer device 18, the only manner in which it can be removed is to use a key to disengage both locking devices 46 which are located on opposite sides of the anti-theft device 10. The presence of traction pads 72 help to further prevent any movement of the computer device 18 laterally with respect to the base frame 12 and clamping member 16.

The anti-theft device shown in FIG. 1 and described above can be used to secure computer equipment devices of varying sizes within predetermined limits. The device specifically illustrated in FIG. 1 is intended to be used with tower type computer housings. It will be appreciated that the anti-lock device 10 could be used with towers having a wide range of different heights as the row of teeth located on each of the connecting members allows the clamping members 16 to be clamped in a selected one of a number of possible positions relative to the base frame 12. Furthermore, the anti-theft device shown in FIG. 1 can be used with computer equipment having a wide range of footprint profiles as well. The largest computer device that the anti-theft device 10 could be used to secure would be limited to a maximum width equal to the spacing between the gusset plates 60, and a minimum width such that the tower would still be able to rest on support pads 66 and cover securing holes 64. Thus, the anti-theft device 10 of the present invention provides a strong anti-theft device which provides a high degree of security against unauthorized access while at the same time being adjustable to accommodate a range of different sized computer devices within predetermined limits.

Figure 5:
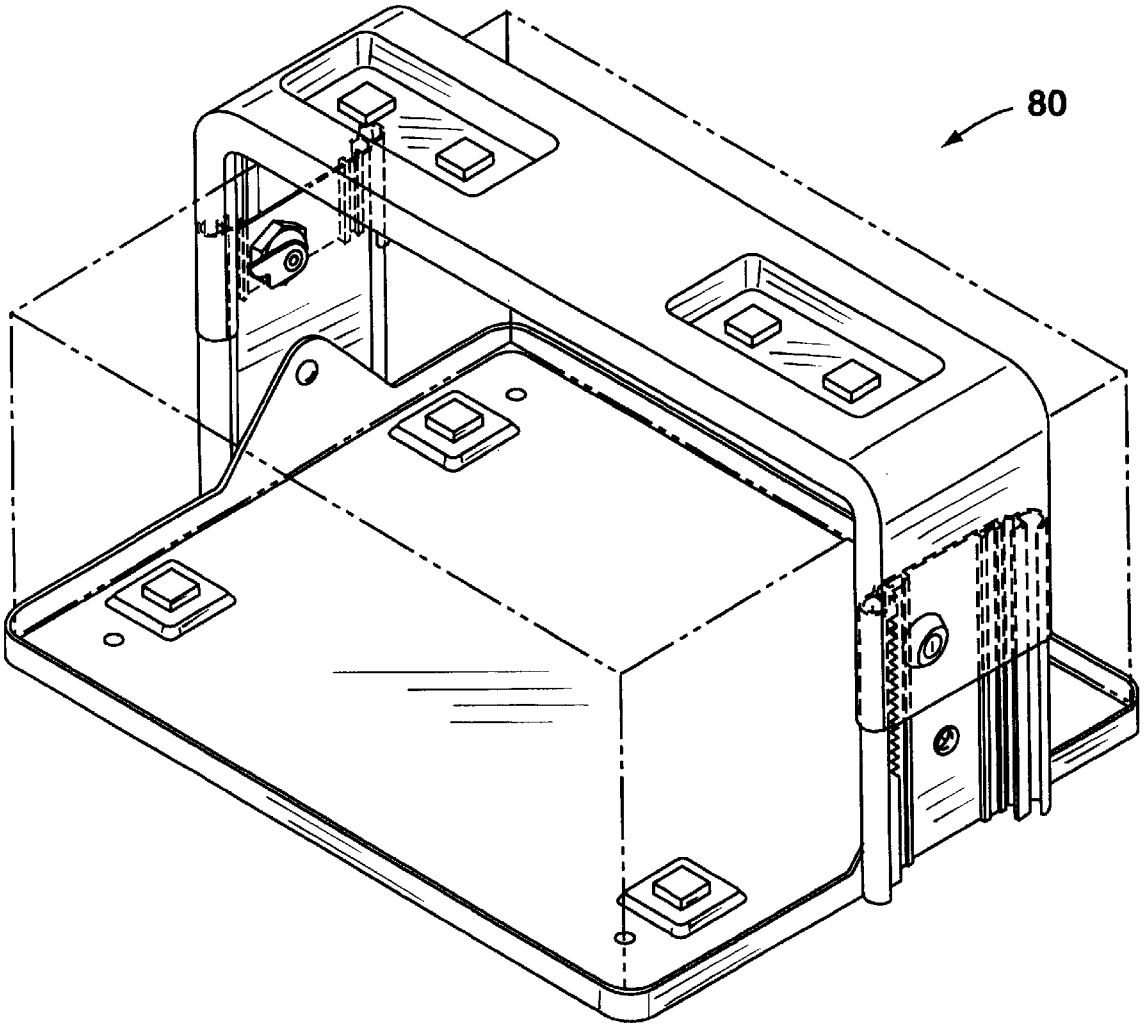
FIG. 5 is a perspective view of a variation of the anti-theft device of the present invention.

Although the computer anti-theft device 10 illustrated in FIG. 1 is generally designed to prevent theft of tower type computer housings, it will be appreciated that the present invention could be incorporated into anti-theft devices for other general shapes of computer and office equipment housing. For example, FIG. 5 illustrates a further anti-theft device 80 which is identical to anti-theft device 10 except that it is configured for use with desktop style computer devices.

It will also be appreciated that the anti-theft device 10 could be constructed in many different ways while still employing the basic principals of the present invention. For example, the interface between base member arms 14,15 and clamping member arms 22,23 could be reversed such that the clamping member arms 22,23 would be slidably received within the base member arms 14,15 with teeth 44 being located on the clamping member arms 22,23 and locking devices 46 being located on the base member arms 14,15. Furthermore a locking device 46 could be provided on only one of the arms 22 or 23 instead of locking devices on both arms. Traction pads 72 could take other forms, such as simple rubber pads. Of course, the anti-theft device of the present invention could also be used to secure other types of office equipment in addition to computer equipment.

As can be seen in FIG. 1, in the preferred embodiment illustrated, gusset plates 60 are preferably located closer to the back of base frame 12 than the front of base frame 12 so that the clamping member 16 will be located closer to the back upper portion of device 18 and the front portion. Such configuration ensures that the handle which is located on the front of many tower type computer housing does not interfere with the operation of the anti-theft device 10.

Figure 6:
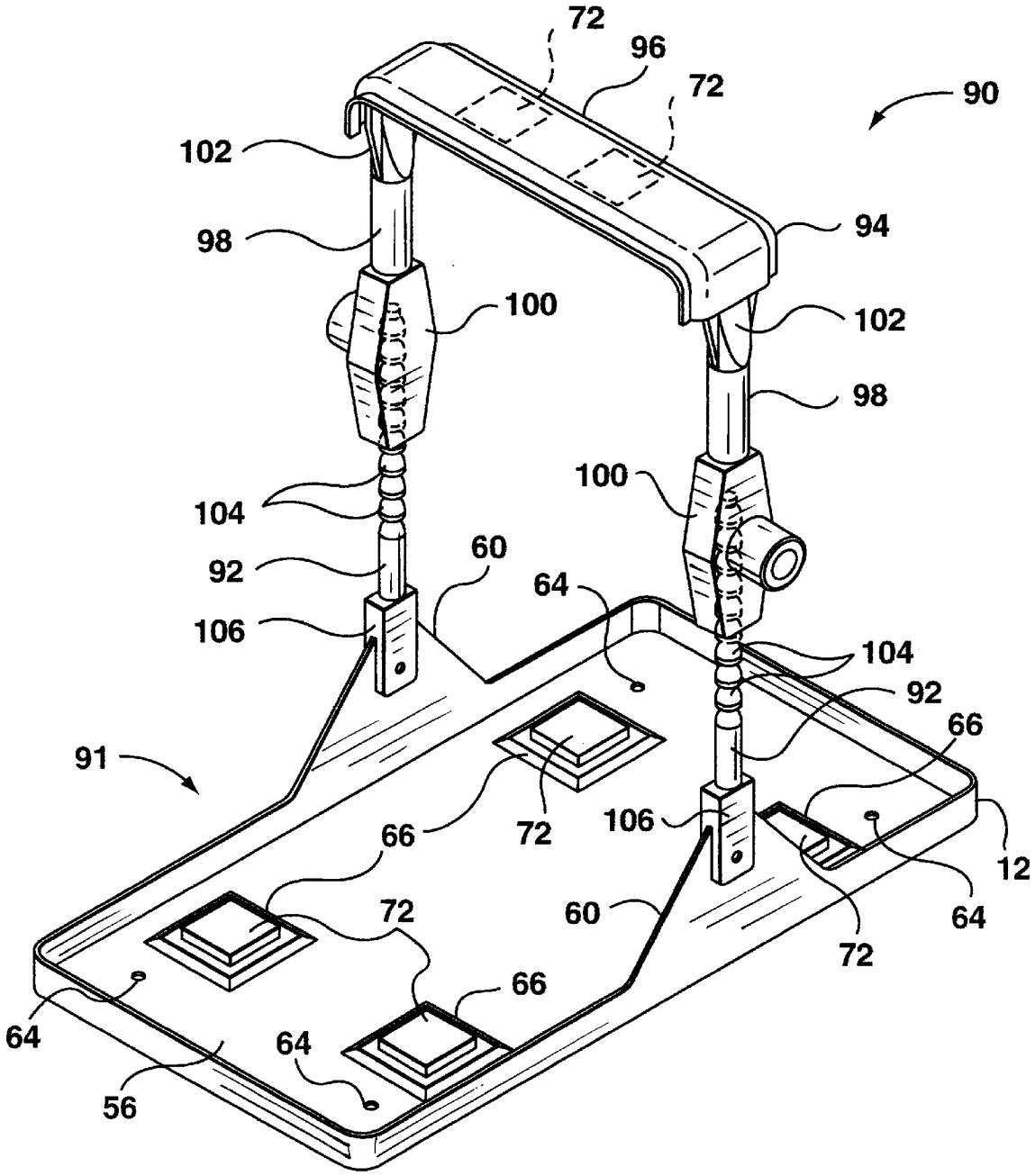
FIG. 6 is a perspective view of a further preferred embodiment of the anti-theft device of the present invention.

A further embodiment of the anti-theft device of the present invention is indicated generally by arrow 90 in FIG. 6. Anti-theft device 90 is similar in construction and operation as above described anti-theft device 10 except as hereinafter noted.

Anti-theft device 90 includes a generally U-shaped base member 91 having a base frame 12 identical to that discussed above. Anti-theft device 90 includes a substantially U-shaped clamping member 94 having an intermediate clamp bar 96 and first and second spaced-apart parallel arms 98 which extend orthogonally from opposite ends of the intermediate clamp portion 96. The clamping member arms 98 are each hollow tubular structures formed from hardened steel tubing and each have a locking device 100 located at a lower end thereof and a steel, L-shaped connecting portion 102 located at an upper end thereof. The intermediate clamp bar 96, which is preferably constructed of hardened steel, is connected to arm members 98 by connecting portions 102.

The first and second base member parallel arms 92, which preferably each comprise a hardened steel rod, are connected to a respective gusset plate 60 of the base frame 12. A number of equally spaced annular teeth 104 are provided along a length of the upper portions of both base member arms 92. The upper ends of the first and second base member arms 92 are configured to be telescopically engaged within the first and second clamping member arms 98, respectively, in order to slidably mount the clamping member 94 to the base member 91. Locking devices 100 engage the annular teeth 104 thus enabling the clamping member 94 to be secured relative to the base frame 12 in one of a selected plurality of possible positions, each of such positions representing a different separation distance between the intermediate clamp portion 96 and the base frame 12. Traction pads 72 are preferably located on the underside of intermediate clamp portion 96 for attachment to a computer equipment device in a manner described above.

The locking device 100 and teeth 104 are preferably configured according to known ratchet type lock technology so that the clamping member 94 and base member 91 can be slid toward each other, but not moved away from each other, when the locking device is locked. A suitable configuration for the locking device 100 and teeth 104 is described below in respect of anti-theft device 200.

Each of the base member arms 92 is connected to its corresponding gusset plate 60 by means of a forked connector 106 which includes two halves between which the gusset plate 60 is received. Hinge pins extend through both halves of the forked connector members 106 and gusset plates 62 to pivotally secure the arms 92 to the base frame 12.

In operation, the anti-theft device 90 operates similar to the anti-theft device 10 described above.

Figure 7:
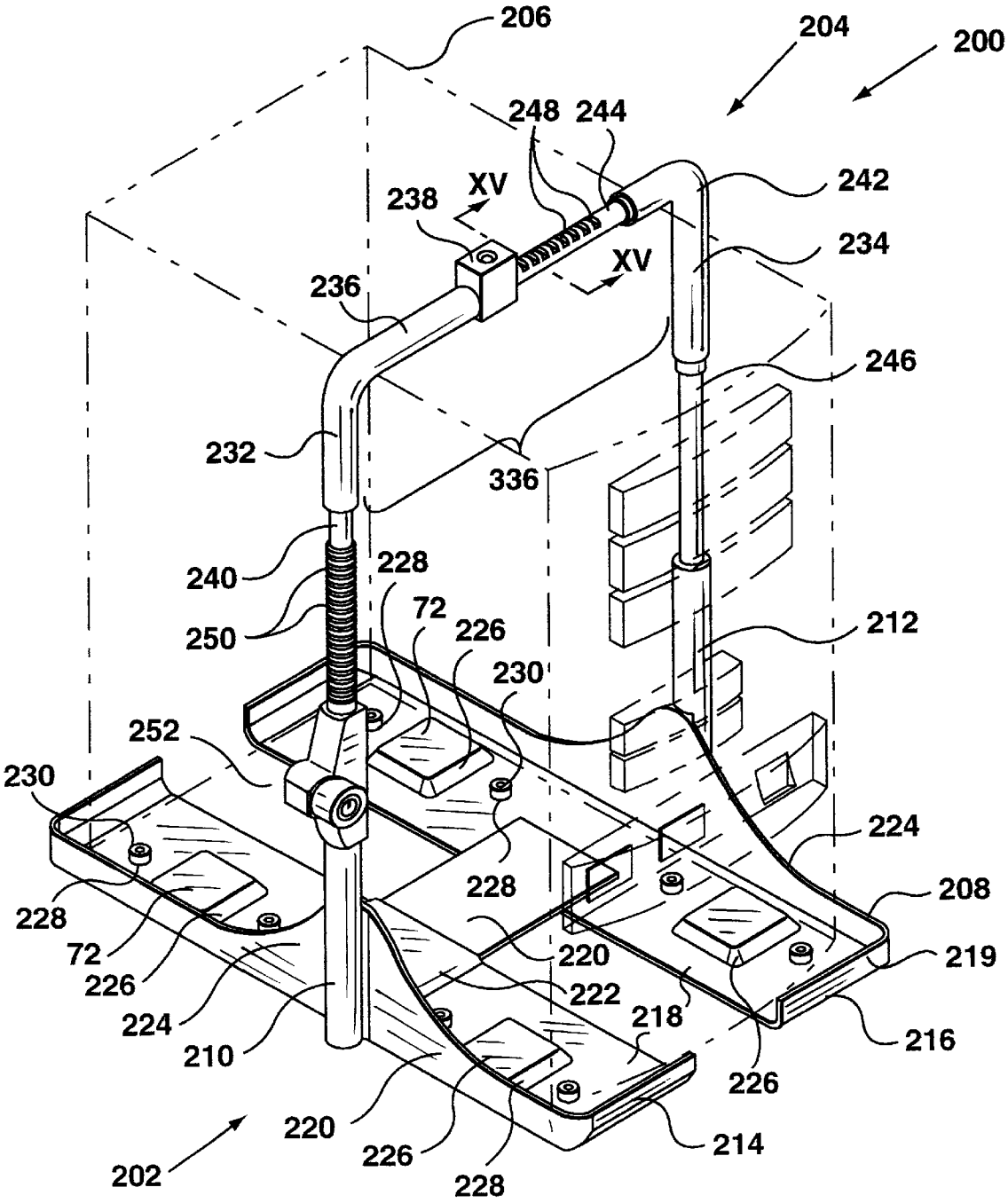
FIG. 7 is a perspective view of still a further preferred embodiment of an anti theft device of the present invention.

FIG. 7 shows an anti-theft device 200 that is a variation of the device 10, in accordance with still a further preferred embodiment of the present invention. The anti-theft device 200 includes a substantially U-shaped base member 202 and a substantially U-shaped clamping member 204 which can be telescopically engaged to base member 202 for securing a computer device (shown by phantom lines 206) therebetween.

As will be explained in greater detail below, both the height and width of the anti-theft device 200 can be adjusted, which enables it to be used to secure office equipment having a wide variety of heights and widths.

The base member 202 includes an intermediate base frame 208 and first and second parallel arms 210, 212 which extend from opposite sides of the base frame 208. The base member arms 210, 212, can be formed from tubular hardened steel. The base frame 208 includes two adjacent base sections 214 and 216 which are slidably connected together such that the width of the base frame 208 can be adjusted.

Each of the first and second base sections 214 and 216 includes a substantially planar rectangular base plate portion 218 and an upwardly extending flange 220 preferably extends around the three outer peripheral edges of each of the base plates 218. In order to slidably connect the first and second base sections 214 and 216 together, a rigid planar tongue member 220 is connected to and extends away from the second base section 216 in the direction of the first base section 214 where it is slidably received within a corresponding sleeve member 222 that is provided on the base plate 218 of the first base section 214.

The flanges 220 which extend around the base plates 218 each include an upwardly extending gusset plate portion 224, with the two gusset plates 224 being located on opposite sides of the base frame 208. The first parallel arm 210 is rigidly connected to the gusset plate 224 of first base section 214, and the second parallel arm 212 is rigidly connected to the gusset plate 224 of the second base section 216.

Each of the base plates 218 preferably includes two upwardly extending support pads 226 for engaging the underside of computer device 206, and conveniently a traction pad 72 may be located on each of the support pads 226 to help prevent lateral movement of the computer device 206 when it is secured with the anti-theft device 200. A plurality of securing holes 228 are located along each of the base plates 218 to allow the base member 202 to be secured to a supporting surface by means of fastening devices such as bolts 230 or screws or ramset nails and the like.

The substantially U-shaped clamping member 204 comprises an intermediate clamp bar 336, with first and second arms 232, 234 which extend orthoganally from opposite ends of the clamp bar 336. The width of the clamp bar 336 is adjustable allowing the distance that the first and second clamp member arms 232, 234 are separated to be set to accommodate the width of the computer device 206. In particular, the clamping member 204 includes a hardened steel L-shaped tubular member 236, a lock device 238 located at one end of the tubular member 236, and a hardened steel cylindrical rod 240 which extends from the other end of the tubular member 236. The clamping member 204 also includes a further hardened steel L-shaped tubular member 242, a cylindrical hardened steel locking bar 244 extending from one end of the tubular member 242, and a second hardened steel cylindrical rod 246 extending from the other end of the tubular member 242. The upper portion of the tubular member 236, and upper lock 238 are configured to telescopically receive the locking bar 244 so that the first and second locking rods 240 and 246 can be arranged parallel to each other and the distance therebetween adjusted by increasing or decreasing the extent to which the locking bar 244 is received within the upper lock 238 and tubular member 236. Thus, the first clamp member arm 232 includes the rod 240 and the portion of tubular member 236 that is axially aligned with the rod 240. The second clamp member arm 234 includes the rod 246, and the portion of the tubular member 234 that is aligned with the rod 246. The clamp bar 336 includes the horizontal portions of the tubular members 236 and 234, lock 238, and locking bar 244. As will be discussed in greater detail below, a number of teeth 248 are preferably provided along the locking bar 244 for selective engagement by the upper lock 238 to prevent separation of the first and second arms 232, 334 when the device 200 is in use.

The first and second locking rods 240, 246 are configured to be telescopically received within the first and second parallel arms 210, 212, respectively, of the base member 202, thus enabling the clamping member 204 to be slidably mounted relative to the base frame 208. A number of ratchet teeth 250 are provided along the portion of the first locking rod 240, and a lock device 252 is located on an upper end of the first parallel arm 210 for receiving and engaging the ratchet teeth 250, such that the clamping member 204 can be locked in place relative to the base member 202, with a desired separation distance between the clamp bar 336 and the base frame 208.

With reference to FIGS. 9–12, the operation of the locking device 252 and its interaction with the ratchet teeth 250 of the first locking arm 240 will now be described in greater detail. The locking device 252 has a hardened steel lock housing 254, a lower end 256 of which is telescopically received within the upper end of the first parallel arm 210 and secured thereto by suitable means such as brazing or welding. A cylindrical passageway 258 is provided through the lock housing 254 for telescopically receiving the first locking rod 240.

The locking device 252 contains a pawl 260 in a blind hole 262, said pawl having an angular end surface 264 urged into the passageway 258 by spring 266. The ratchet teeth 250 are preferably frustal-conical projections located along a portion of the length of the first locking rod 240.

Figure 8:
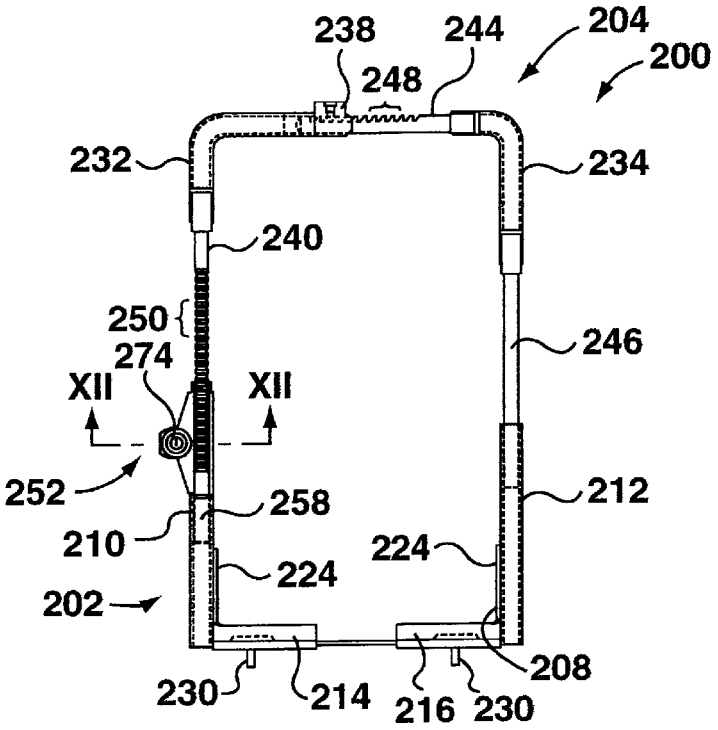
FIG. 8 is a elevational view of the anti theft device of FIG. 7.
Figure 9:
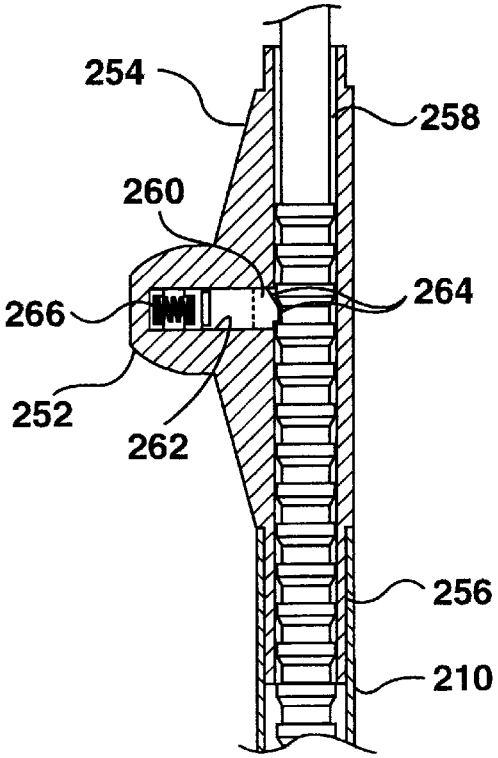
FIG. 9 is a partial elevation of the anti theft device of FIG. 7, showing the locking device engaging the teeth of the first locking arm.
Figure 10:
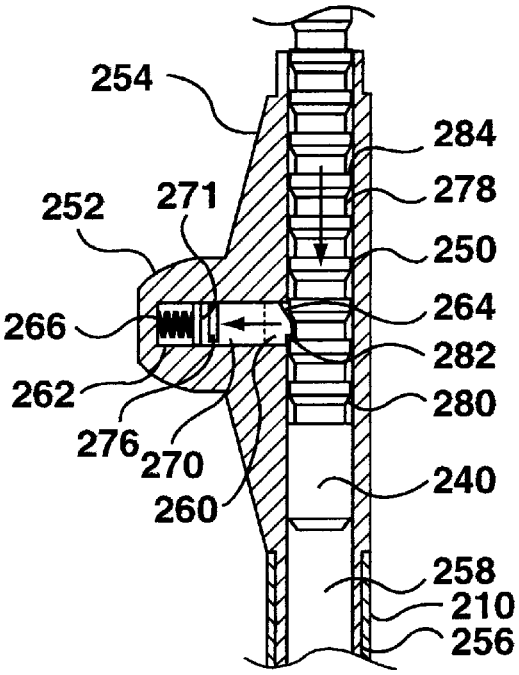
FIG. 10 is an enlarged partial cross sectional view of a portion of the locking device showing movement of the ratchet teeth during insertion into the locking device.
Figure 11:
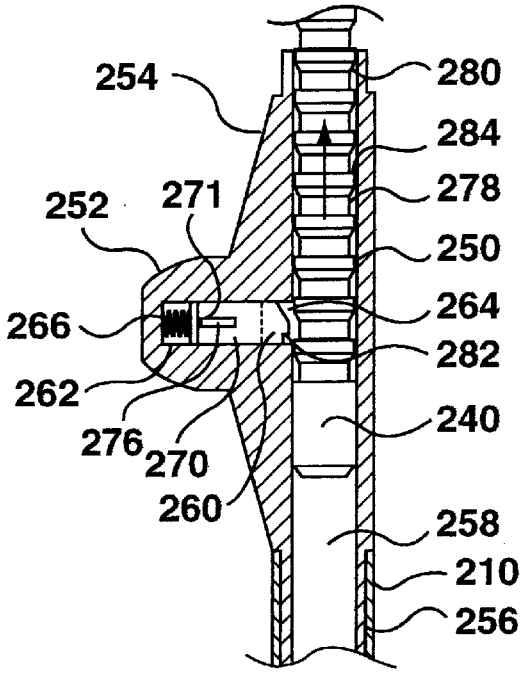
FIG. 11 is an enlarged partial cross sectional view of the same portion of the locking device showing the ratchet teeth being withdrawn from the locking device.

FIG. 10 shows the action of the locking device with the first locking rod 240 being inserted into passageway 258, while FIG. 11 shows the locking device 252 in the unlocked position, with the pawl in a retracted position thereby facilitating removal of the first locking rod 240 from the passageway 258. The lock housing 252 includes a blind hole 262, and a lock cylinder hole 268 at right angles to the blind hole 262. A locking mechanism 255 disposed within the lock housing 254 includes a coil spring 266 and a ratchet pawl 260 extending from the coil spring and through an end of the blind hole 262 into the annular passageway 258. The ratchet pawl 260 includes an angular and surface 264, a groove 270 and a torque blade surface 271 within the groove 270. The locking mechanism 255 further comprises a key lock cylinder 272 having a key slot 274 (shown in FIG. 8) and a torque blade 276. The torque blade extends into the groove 270 in the ratchet pawl 260 to register and co-operate with the torque blade surface 271.

Figure 12:
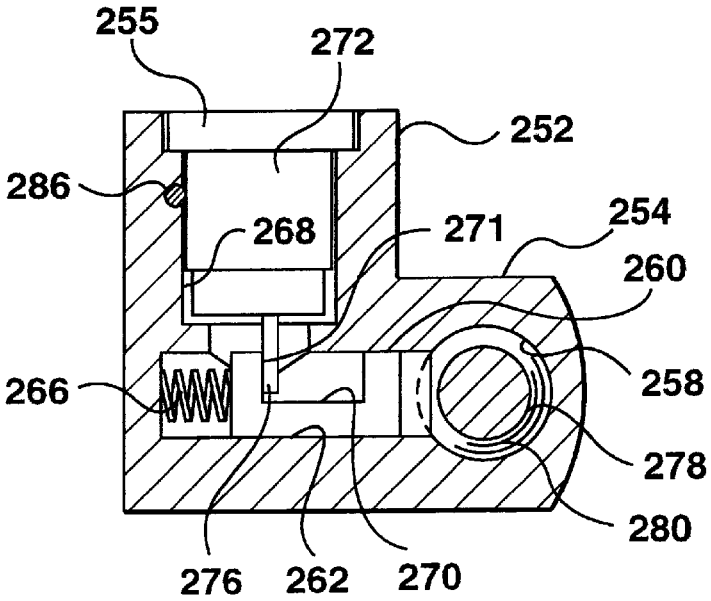
FIG. 12 is a detailed cross sectional view taken along line XII—XII of FIG. 8, showing a locking mechanism useful in connection with the present invention.

Operation of the locking mechanism 255 is shown in FIGS. 10, 11 and 12. As shown in FIG. 12, the coil spring 266 normally biases the ratchet pawl 260 outwardly of the blind hole 262 into engagement with the inner cylindrical surface 278 of the ratchet teeth 250. Movement of the first locking arm through the annular passageway 258 indicated by the arrow in FIG. 10 causes the conical bearing surface 280 of the ratchet teeth to act against the angular end surface 264 of the pawl, whereby the pawl 260 is biased into the blind hole 262 thereby compressing spring 266. As each ratchet tooth passes the pawl, the spring 266 urges the pawl back into the annular space between the conical surfaces. Use of the key lock cylinder 272 to rotate torque blade 276 to act against the torque blade surface 271 of the pawl, as shown in FIG. 11, holds the pawl in the position retracted from the annular passageway 258, thereby permitting withdrawal of the locking bar 240 from the passageway 258. However, with the pawl in a position shown in FIG. 10, the stop surface contact 282 of the pawl abuts the stop surface 284 of the ratchet tooth thereby preventing the arm 240 from being withdrawn from the locking device 252. This represents the locking device in the locked position. The key lock cylinder 272 is retained within the key hole by locking pin 286.

Figure 13:
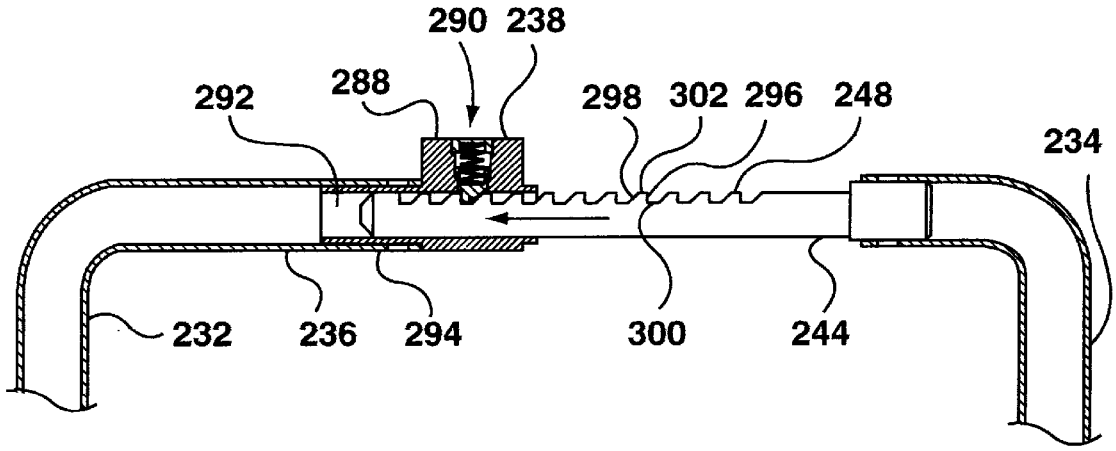
FIG. 13 is a partial elevation of the anti-theft device of FIG. 7, showing the upper lock engaging the teeth of the locking bar.
Figure 15:
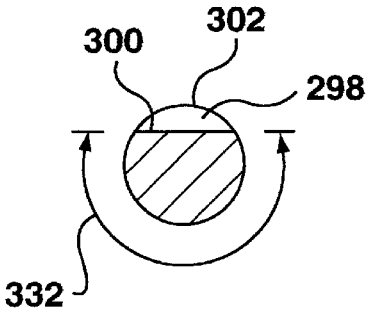
FIG. 15 a cross section view taken along the lines XV—XV of FIG. 7.
Figure 14:
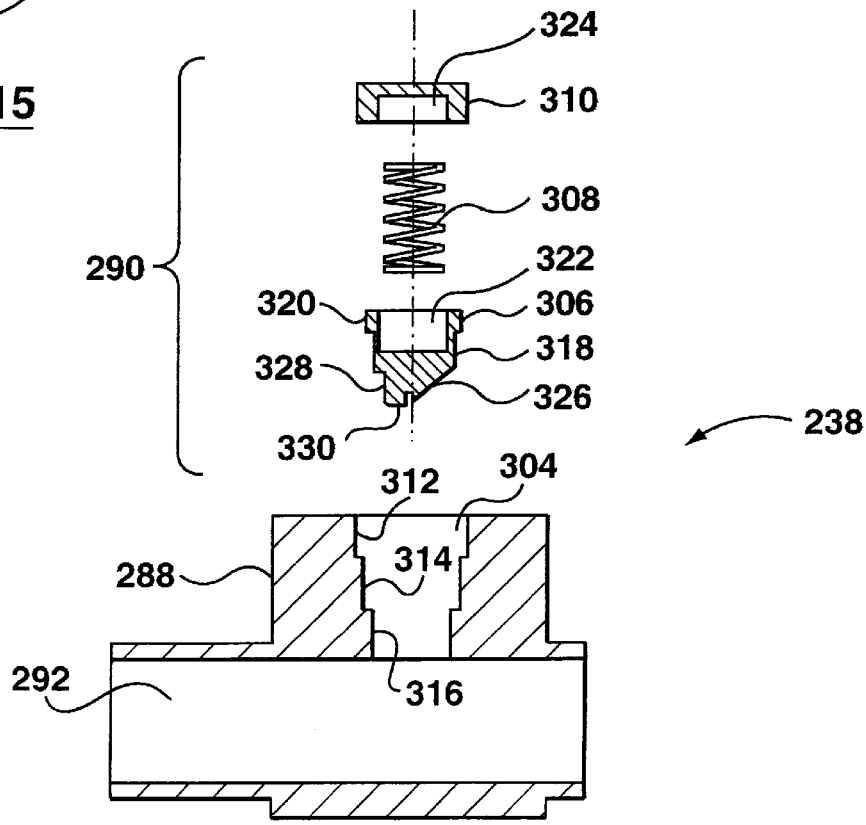
FIG. 14 is an exploded cross-sectional view of the upper lock.
Figure 16:
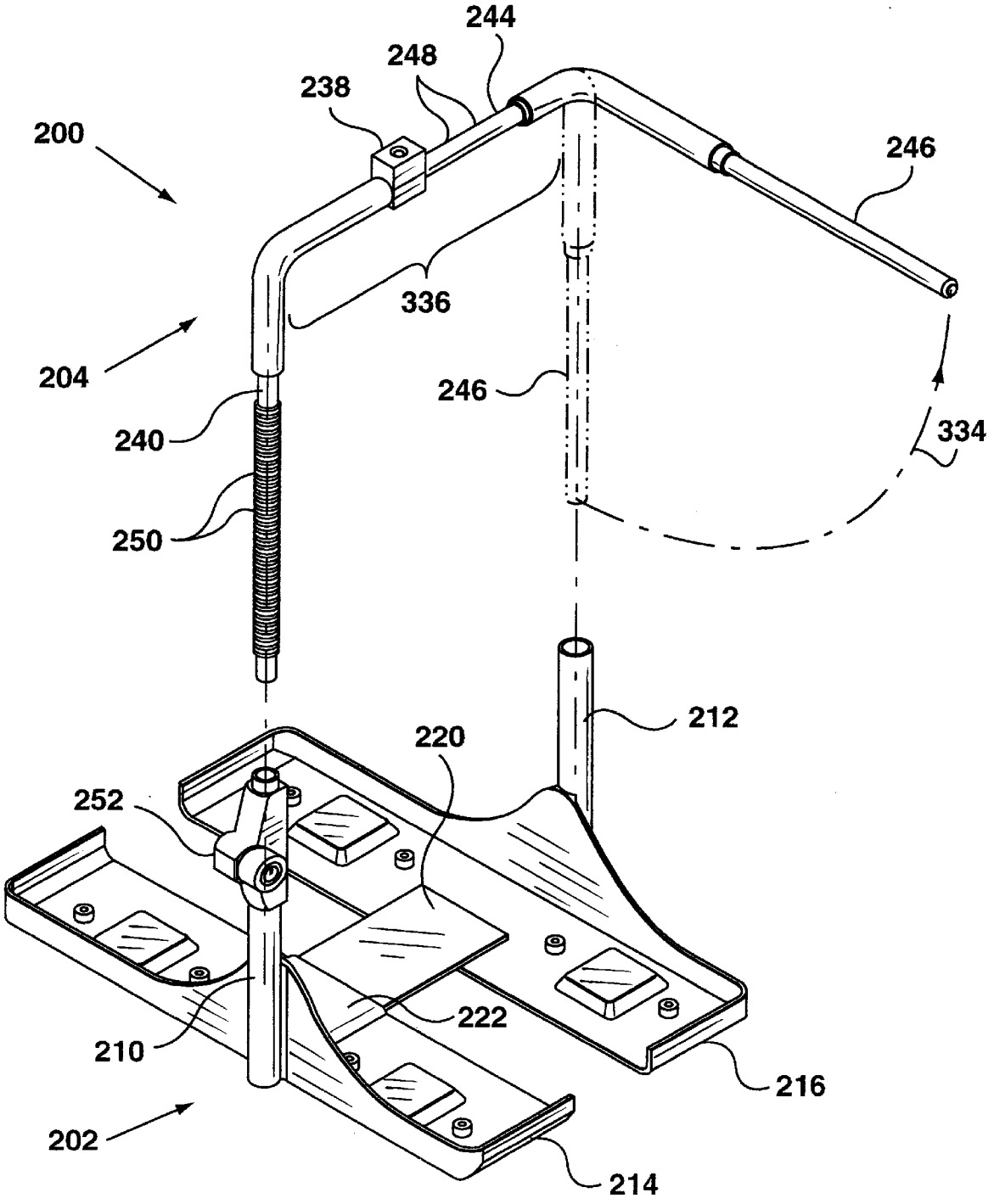
FIG. 16 is a further perspective view of the anti-theft device of FIG. 7.

With reference to FIGS. 13, 14 and 15 the operation of the upper lock 238 and the manner in which it engages the teeth 248 that are located along the locking bar 244 will now be described.

The upper lock 238 includes a housing 288, and a locking mechanism 290 which is contained within housing 288 and functions to engage the teeth 248 of the locking bar 244.

The housing 288, which is preferably formed from hardened steel, includes an annular passageway 292 therethrough for receiving the locking bar 244. The housing 252 includes a cylindrical portion 294 through which the passageway 292 extends and which is telescopically received within the upper end of the first L-shaped tubular member 236, and is secured thereto by suitable means such as brazing or welding.

Each of the ratchet teeth 248, which are located longitudinally along the locking bar 244 has a stop surface 296, and a sloped surface 298 connecting a flat landing surface 300 with an outer partially cylindrical surface 302.

The lock housing 288 includes a blind hole 304 located at right angles to the annular passageway 292. The locking mechanism 290, which includes a ratchet pawl 306, a coil spring 308 and a retaining plug 310 is received within the blind hole 304 such that the ratchet pawl 306 is urged into the passageway 292 for engaging the teeth 248 of the locking bar 244. In particular, the blind hole 304 comprises three vertically aligned cylindrical sections 312, 314 and 316, the sections 314 and 316 each having a smaller diameter than the section above it. The lower section 316 is configured to slidably receive a lower portion 318 of the ratchet pawl 306, and the middle section 314 is configured to slidably receive a cylindrical upper portion 320 of the pawl 306. The difference in diameter between the upper and lower portions of the pawl 306, and the middle and lower sections of the blind hole 304 function to limit the distant to which the lower portion 318 of the ratchet pawl can extend into the passageway 292. The retainer plug 310 is received within the upper section 312 of the blind hole 304 and preferably secured thereto by brazing or welding or some other suitable means. A lower end of the spring 308 is received within an upwardly opening cylindrical cavity 322 in the pawl 306, and the other end of the spring 308 is received within a downwardly opening cavity 324 located in the retainer plug 310. When the locking mechanism 290 is received within the housing 288, a lower portion of the pawl 306 is urged into the annular passageway 292 by the spring 308.

In particular, an angular end surface 326 of the pawl is urged into the passageway 292. The pawl 306 also includes a stop surface contact 328. As shown in FIG. 13, the coil spring 308 normally biases the ratchet pawl 306 outwardly of the blind hole 304 into engagement with the flat landing surface 300 of the ratchet teeth 248. Movement of the locking bar 244 through the annular passageway 292 in the direction indicated by the arrow in FIG. 13 causes the sloped surface 298 of the ratchet teeth to act against the angular end surface 326 of the pawl, whereby the pawl 306 is biased into the blind hole 304 thereby compressing spring 308. As each ratchet tooth passes the pawl, the spring 308 urges the pawl back into engagement with the next flat landing surface 300. So long as the teeth 248 are facing upward in the direction of the pawl 306, retraction of the locking bar 244 from the passageway 292 is prevented as the stop surface contact 328 of the pawl engages the stop surface 296 of the ratchet tooth.

Once the locking bar 244 has been inserted into the passageway 292 far enough that the leading tooth 248 has passed beyond the pawl 306, the locking bar 244 must be rotated relative to the lock 238 in order for the locking bar 244 to be retracted from the lock 238. With reference to FIG. 15, it will be understood that teeth 248 only partially circumscribe the locking bar 244, and a circumferential portion, indicated by 332, is smooth along the length of the bar 24. When the locking bar 244 is rotated relative to the lock 252, the flat landing surface 300 will force the pawl 306 back into the blind hole 304 until eventually the lower end surface 330 of the pawl will rest on the cylindrical surface portion 332 of the bar 244. With the locking bar 244 located in such position, the pawl 306 does not engage any of the teeth 248, and according the locking bar 244 can be withdrawn from the lock 238.

With reference to FIGS. 7–16, the operation of the computer securing device 200 to secure the computer equipment component 206 will now be described in greater detail. As a first step, the width of the base member 202 is adjusted according to the width of the computer device 206 to be secured. In this regard, the distance that the first base section 214 and second base section 216 are separated from each other is adjusted by either inserting the tongue 220 further into sleeve 222, or retracting it therefrom, as required so that the computer device 206 can be snugly received between the first and second parallel arms 210, 212. Once the width of the base member 202 has been appropriately adjusted, the base frame 208 is secured to a supporting surface by means of bolts 230, or screws or ram set nails or similar securing means, placed through securing holes 228. The computer device component 206 is then positioned on the base frame 12 between first and second arms 210 and 212 such that is base is received within the area defined by flanges 219 and portions of its lower surface rest on the support pads 226. As noted above, in respect of anti-theft device 10, traction pads 72 may be provided on each of the support pads 226 to help prevent against lateral movement of the computer device 206. Once the computer device 206 is placed on the base frame 12, the width of the clamping member 204 is adjusted so that the spacing between the first and second arms 232, 234 corresponds to the distance between first and second parallel arms 210, 212 of the base member 202.

The width of the clamping member 204 can be decreased by pushing the first and second arms 232, 234 towards each other, thereby increasing the distance that the locking bar 244 is received within the passageway 292 of the lock 238. When the first and second arms 232, 234 are arranged parallel to each other, the teeth 248 are aligned with and engaged by the spring loaded pawl 306. Accordingly, although the arms 232 and 234 can be pushed together when they are parallel to each other, they cannot be separated. Therefore, in order to increase the distance between the parallel arms 232 and 234 it is necessary to rotate one of the arms relative to the other as indicated by dashed line 334 in FIG. 16, which results in rotation of the locking bar 244 relative to the locking device 238. Such rotation causes the spring loaded pawl 306 to be pushed upwards into the blind hole 304 and out of engagement with teeth 248. With the locking bar 244 in such position, it can be retracted from the lock 238, thereby allowing the width between the first and second locking arms 240, 246 to be increased.

Once the desired width is achieved, and the first and second locking arms 232 and 234 parallel to each other, the clamping member 204 is slidably mounted to the base member 202 by telescoping the first and second rods 240, 246 into the first and second parallel aims 210, 212, respectively, of the base member 202. Clamping member 204 is slid downward, with the ratchet teeth 250 each being subsequently engaged by the locking device 252 until the clamping bar 336 of the clamping member 204 comes to rest on the upper surface of the computer device 206, at which time the computer device is effectively clamped to the base member 202 by the clamping member 204.

Once the rods 240 and 246 are located within the first and second parallel arms 210, 212 respectively, they are locked in parallel relation to each other, with the result that the teeth 248 located along the locking bar 244 cannot be rotated out of contact with the spring loaded pawl 206. Thus, once the clamping member 204 is mounted onto the base member 202, the lock 238 engages teeth 248 to prevent prying apart of the first and second locking arms 240, 246.

It will be appreciated that the anti-theft device 200 is a device which can be adjusted both in height and width in order to be used with a wide range of computer and office equipment components having different heights and widths. In particular, the width of the anti-theft device 200 is adjusted by setting the separation between the first and second base sections 214 and 216 by adjusting the degree to which the tongue 220 is received within sleeve 222, and adjusting the separation between the first clamping member arm 232 and second clamping member 234 by adjusting the extent to which the locking bar 244 is telescopically received within lock 238. The height of the anti-theft device 200 is dependent upon the extent to which the first and second locking rods 240, 246 are received within the first and second parallel arms 210, 212 respectively. It will be appreciated that the anti-theft device 200 can be used to secure office equipment components having a wide variety of sizes, and furthermore, anti-theft devices having different sizes and proportions can be constructed, each for use with office equipment components falling within certain sizes. For example, the anti-theft device shown in FIGS. 7 can be used with tower-type computer components of varying sizes. The anti-theft device 200 could also be constructed with a wider base member 202, and a lower height for use with desktop style computer chassis.

It will be appreciated that the lock devices 238 and 252, and their associated ratchet teeth 250, and 248 could take a number of different configurations. In this regard, the pawls of each of the locking devices functions as a stop member, with the teeth acting as stop surfaces to be engaged by the stop member. Other possible locking configurations include, for example, the substitution of aligned holes through the first parallel arm 210, and the tubular member 236 in place of locks 252 and 238, for receiving a pad lock or bolt. In such a configuration, teeth 250 and 248 would be replaced with rows of holes passing through the first locking rod 240 and locking bar 244, respectively such that the pad locks or bolts could be used to secure the first locking rod 242 to the first parallel arm 210, and the locking bar 244 to the tubular member 236. Furthermore the L-shaped tubular member 242, cylindrical locking bar 244 and rod 246 could be collectively formed from a unitary, hardened steel L-shaped rod. Additionally, the anti-theft device could be constructed using the extruded aluminum construction of anti-theft device 10 as shown in FIGS. 1–4, and use locking devices similar to those described in respect of anti-theft device 10.

It will also be appreciated that the base sections 216 and 214 of anti-theft device 200 need not necessarily be slidably connected together, but rather just secured in position relative to each other to a securing surface.

Figure 17:
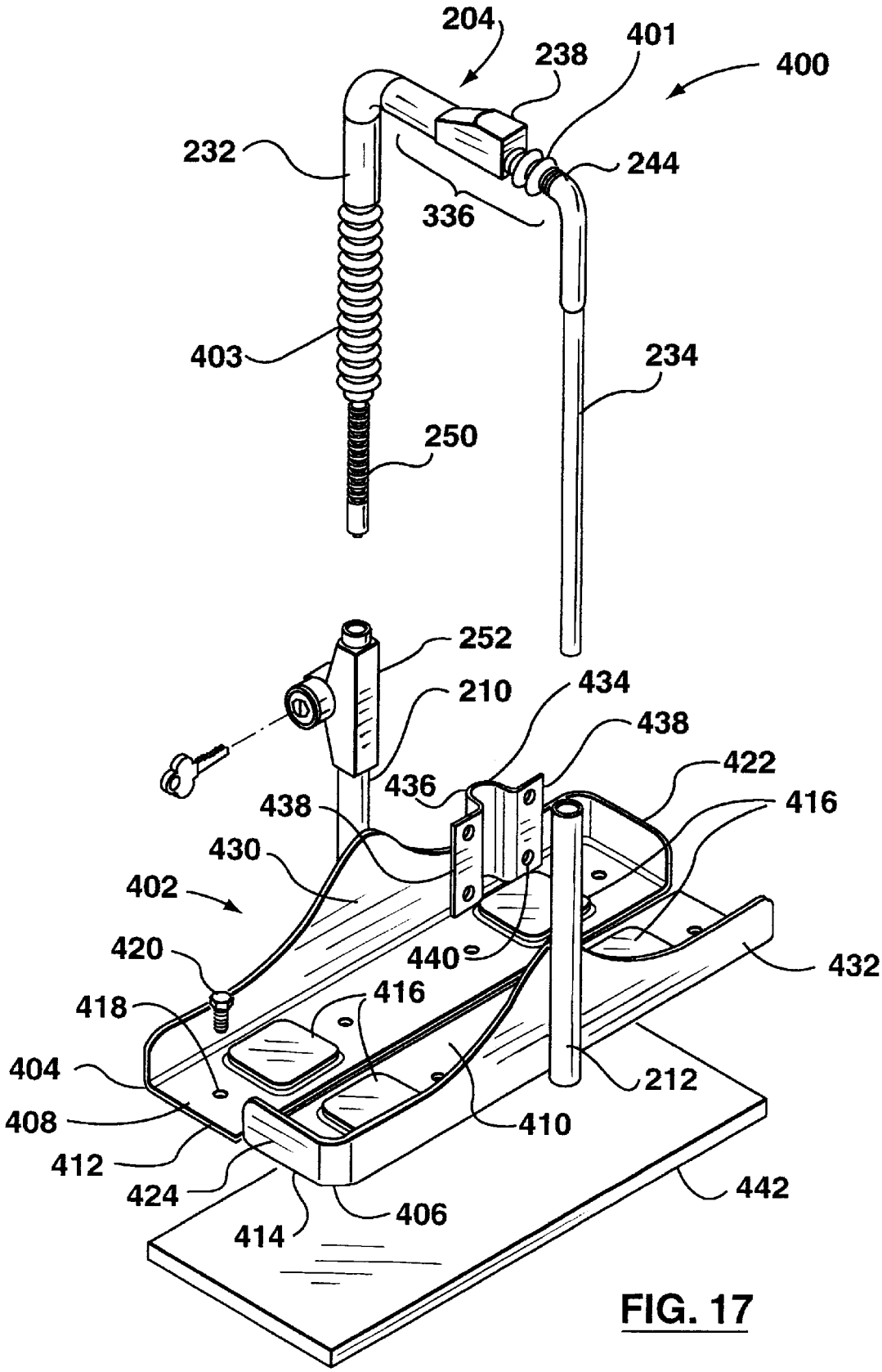
FIG. 17 is a perspective view of a further embodiment of an anti-theft device for computers.

FIG. 17 shows anti-theft device 400 that is a further preferred embodiment of the present invention. The anti-theft device 400 is substantially identical in construction and operation to the anti-theft device 200 described above, except as noted hereafter. The anti-theft device 400 is configured such that the height, width and length of the device 400 can be adjusted, which provides it with a great deal of flexability for securing office equipment having a wide variety of heights, widths and lengths.

The anti-theft device 400 includes clamping member 204 for placement over the office equipment component to be secured. As noted above in respect of anti-theft device 200, the clamping member 204 includes first and second arms 232, 234, which extend from opposite ends of an intermediate clamp bar or restraining member 336 for straddling the office equipment component to be secured. The width of the clamping member 204 is adjustable depending on the extent to which the locking bar 244 is inserted into upper lock device 238. Conveniently, a flexible boot 401 having bellows or accordion pleats can be secured to the locking bar 244 in contact with the lock device 238 such that the bellows or accordion pleats are compressed or folded together when the locking bar 244 is telescoped into the upper lock device 238. A further flexible boot 403 can be secured to the arm 232 such that the bellows or accordion joints of the further boot 403 compress or fold together when the arm 232 is telescoped into the first arm 210 of base 402.

The anti-theft device 400 includes a base 402 having first and second upwardly extending arms 210, 212 for telescopically receiving the first and second arms 232, 234 of the clamping member 204. A lock device 252 is provided for selectively engaging teeth 250 that are provided on the first arm 232 of the clamping member 204. The base 402 of the anti-theft device 400 differs from the base member 202 of the anti-theft device 200 described above in that it permits both the width and the length of the base to be adjusted. In particular, the base 402 includes first and second base sections 404 and 406. The first and second base sections 404 and 406 each have a substantially planar rectangular base plate 408 and 410. The base plate 408 of first base section 404 has a lower basal surface 412, and the second base plate 410 of second base section 406 has a lower basal surface 414, for resting on a support surface. The first and second base plates 408 and 410 also each have an upwardly facing surface upon which are provided upwardly extending support pads 416 for supporting the office equipment component. A plurality of securing holes 18 are provided through each of the base plates 408 and 410 to permit the base plates to be secured to a support surface by bolts 420 or other similar fastening devices.

As can be seen in FIG. 17, a upwardly extending back peripheral wall or flange 422 is provided on the rearward end of the first base plate 408, and a upwardly extending forward peripheral wall or flange 424 is provided on the forward end of the second base plate 410. As well, the forward end of the first base plate 408 is open in that it does not include an upward flange, and the rearward end of the second base plate 410 is also open in that it does not include a back peripheral wall. As will be described in greater detail below, such a configuration allows the front end of a computer to extend beyond the front end of the first base section 404, and the back end of a computer device to extend beyond the back end of the second base section 406.

Figure 18:
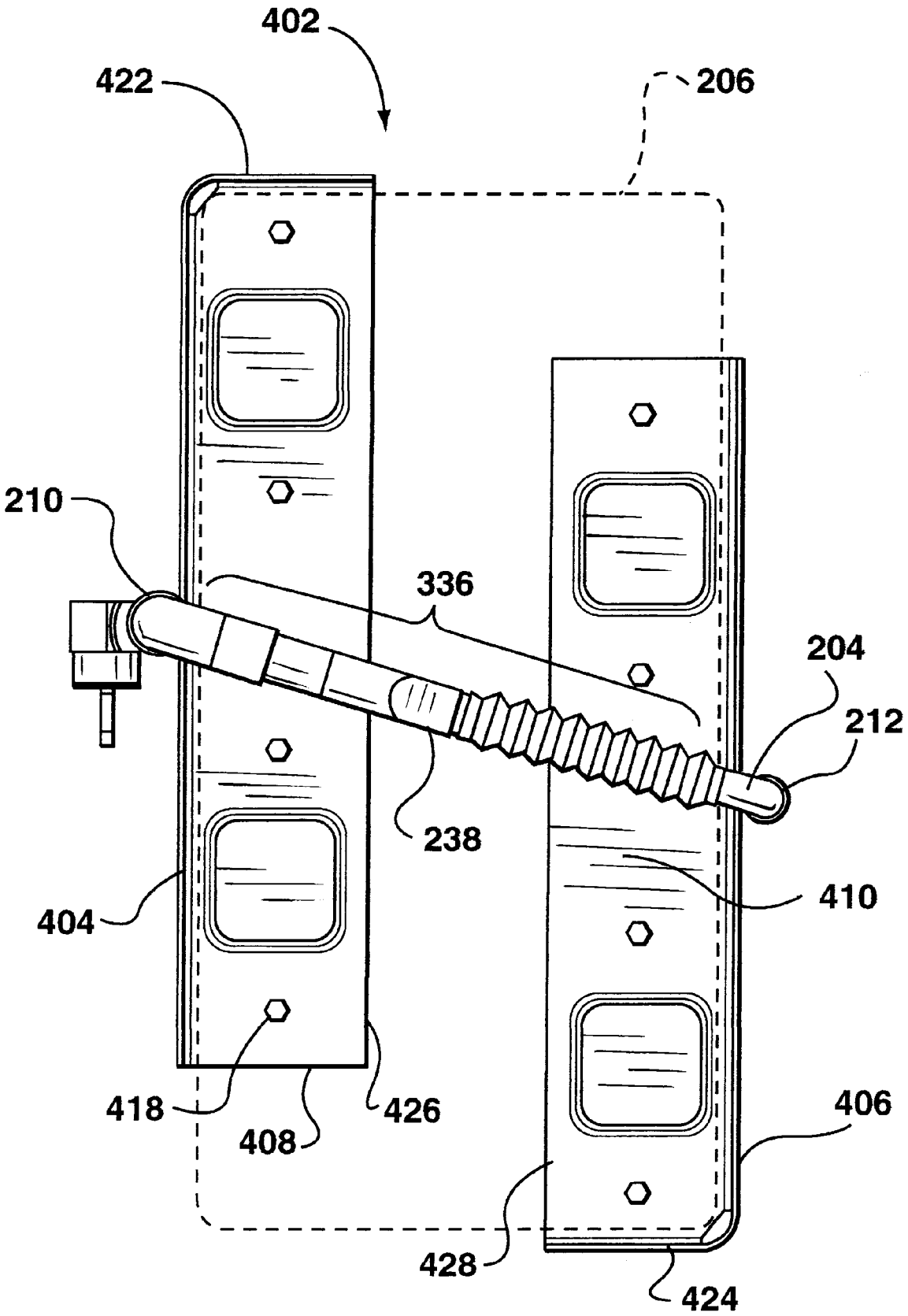
FIG. 18 plan view of the anti-theft device of FIG. 17, showing the base sections separated.
Figure 19:
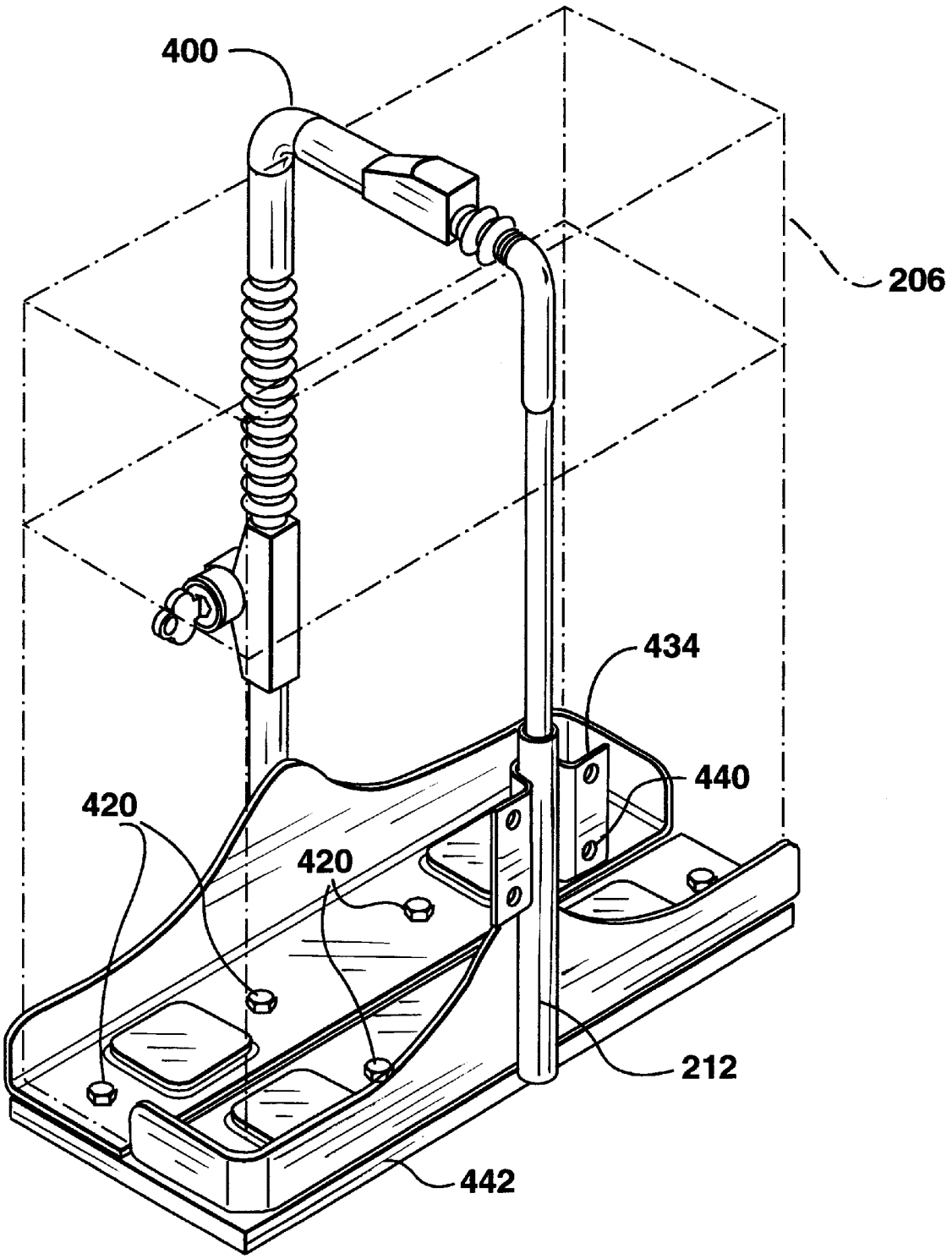
FIG. 19 is a further perspective view of the anti-theft device of FIG. 17.

The first and second base plates 408 and 410 each include a longitudinal inner peripheral edge 426, 428, respectively, extending between the front end and the back end thereof (see FIG. 18). The first and second base plates 408 and 410 also each include an outer peripheral edge along which an upwardly extending sidewall or flange 430, 432, respectively, is located. The first base arm 210 is preferably secured to the outer surface of the sidewall 430 of the first base section 404, and the second base arm 212 is preferably secured to the outer surface of the sidewall 432 of the second base section 406.

As noted above, the configuration of the anti-theft device 400 allows the height, width and length of the device to be adjusted in order to allow it to secure computer devices having a wide range of dimensions. In particular, the height of the device can be adjusted by varying the extent to which the clamping member 204 is telescopically engaged to the base 402. The width and length of the anti-theft device 400 is determined by the positioning of the base sections 404 and 406 on the support surface. In particular, the base sections 404 and 406 can be secured to a support surface in alignment with each other and adjacent to each other as shown in FIG. 17 by placing bolts or other fastening devices 420 through securing holes 418 into the support surface. When secured in such a manner, the base 402 can receive an computer equipment component having a width up to the distances between the sidewalls 430, 432, and a length up to the distance of separation between the back peripheral wall 422 and the forward peripheral wall 424.

As shown in FIG. 18, the first base section 404 and second base section 406 can be off-set relative to each other to accommodate a computer device (illustrated by dashed line 206) having a foot print which is larger than the combined width of the base sections, and which is longer than the length of either of the base sections. As will be appreciated from FIG. 18, when the first and second base sections are off-set relative to each other, the computer device will extend beyond the forward end of the first base plate 408, and beyond the back end of the second base plate 410. The back peripheral wall 422, of the first base section 404 prevents backward movement of the computer device in the direction parallel to the support surface. The forward peripheral wall 424 of the second base section 406 prevents forward movement of the computer device 206 in a direction parallel to the support surface. Upward movement of the computer device 206 is prevented by the clamping member 204 (the width of which can be adjusted to accommodate the separation between the first and second base arms 210, 212). It will be appreciated that the securing holes 418 are covered by the computer device 206, thereby preventing access to the bolts or other securing devices which extend through such holes to secure the anti-theft device 400 to a support surface.

In some instances, it may not be possible or desirable to secure the anti-theft device 400 directly to a horizontal support surface such as a floor. With reference to FIG. 17, in such circumstances a securing clamp 434 can be used to secure the anti-theft device to a further support surface such as a wall or desk. The securing clamp 434 comprises an intermediate U-shaped section 436, and planar fastening plates which extend in opposite directions from the opposite ends of the U-shaped section 436. The U-shaped section 436 is adapted to snugly engage the second base arm 212 such that screws, bolts, and the like can be placed through fastening holes 440 which are provided through plates 438 in order to secure the anti-theft device 400 to a vertical support surface such as a wall, or the side of a desk. When the clamp 434 is used to secure the anti-theft device, the base sections 404 and 406 can be secured to a support plate 442 by bolts 420 in order to prevent movement of the base sections relative to each other. It will be appreciated that the clamp 434 could also be used to secure the anti-theft devices 90 and 200 to a vertical support surface, and in the case of anti-theft device 90, a further support plate 442 would not be required.

As will be apparent to those skilled in the art in the light of the foregoing disclosure, many alterations and modifications are possible in the practice of this invention without departing from the spirit or scope thereof. Accordingly, the scope of the invention is to be construed in accordance with the substance defined by the following claims.

What is claimed is:

1. An anti-theft device for securing an office equipment component to a support surface, comprising:

a base including first and second base sections movable relative to each other, each having a basal surface for resting on the support surface and an opposite facing surface having a support portion for supporting the office equipment component, a first base arm extending from said first base section in a direction opposite the basal surface of said first base section, and a second base arm extending from said second base section in a direction opposite the basal surface of said second base section such that upon placement of the office equipment component on said support portions the component will be located between said first and second base arms;

a clamping member for placement over the office equipment component, having an intermediate restraining bar and first and second spaced apart, parallel arms extending from the restraining bar for straddling the office equipment and telescopically engaging the first and second base arms, respectively, said restraining bar having an adjustable width, one of said first clamping member arm and said first base arm having a plurality of longitudinally spaced engagement surfaces located along a portion of the length thereof; and a locking device associated with the other of said first clamping arm and said first base arm engaging the engagement surfaces and preventing the clamping member from being pulled apart from the first base section when the locking device is locked.

2. The anti-theft device according to claim 1 wherein each of said base sections has a forward end and a rearward end, one of said base sections having a back peripheral wall located at the rearward end thereby extending in a direction opposite the basal surface of said one base section, the other of said base sections having a front peripheral wall located at the front end thereby extending in a direction opposite the basal surface of said other base section, the back wall preventing movement of the office equipment component parallel to the support surface in a rearward direction, and the front wall preventing movement of the office equipment component parallel to the support surface in a forward direction.

3. The anti-theft device according to claim 2 wherein the base section having said front wall has a rearward end that is generally co-planar with the support portion such that one end of the office equipment component can extend beyond the rearward end of such base section; and the base section having said back wall has a forward end that is generally co-planar with the support portion of the base section such that an opposite end of the office equipment component can extend beyond the forward end of such base section.

4. The anti-theft device according to claim 2 wherein securing holes are provided through said first and second base sections for securing said sections to the support surface.

5. The anti-theft device according to claim 4 wherein said base sections each have base plates rectangular in shape and said securing holes are formed therethrough in locations inwardly offset from an outer edge of said base plates such that at least one of said securing holes in each base plate will be concealed when the office equipment component is located on said base plates.

6. The anti-theft device according to claim 1 wherein said locking device and said engagement surfaces are a ratchet and teeth assembly to permit said base and clamping member to be telescoped together while preventing them from being pulled apart when said locking device is locked.

7. The anti-theft device according to claim 1 wherein said restraining bar includes a locking bar telescopically received within a tubular member, one of said arms of said clamping member being connected to said tubular member, the other of said arms of said clamping member being connected to said locking bar.

8. The anti-theft device according to claim 7 including locking means associated with said tubular member and locking bar for preventing withdrawal of said locking bar from said tubular member when the first and second arms of the clamping member are located parallel to each other.

9. The anti-theft device according to claim 8 wherein said locking means includes a lock having a spring loaded pawl mounted on said tubular member, and a row of ratchet teeth located on a surface of said locking bar for engagement by said pawl, said teeth and pawl being configured so that when said teeth are engaged by said pawl, said locking bar can be inserted further into said tubular member, but not removed therefrom.

10. The anti-theft device according to claim 8 wherein said tubular member and said locking bar each have a circular cross section and said teeth only partially circumscribe said locking bar such that rotation of said locking bar relative to said tubular member causes said pawl to cease engaging said ratchet teeth thereby allowing withdrawal of said locking bar from said tubular member.

11. An anti-theft device according to claim 1 including a clamp member for securing one of said arms to a further support surface.

12. An anti-theft device according to claim 11 including a support plate secured to the basal surfaces of said first and second base sections, said support plate having a further basal surface for resting on the support surface.

13. An anti-theft device according to claim 11 wherein said clamp member includes a generally U-shaped intermediate portion for engaging one of the first and second base arms.

14. An anti-theft device for securing an office equipment component to a support surface; comprising:

a base including first and second base sections movable relative to each other, each having a downward facing basal surface for resting on the support surface, and an upward facing surface having a support portion for supporting the office equipment component;

first and second base arms extending upwardly from the first and second base sections respectively and arranged such that the office equipment component can be located on the support portions, between said first and second base arms;

a clamping member for placement over the office equipment component, having an intermediate retaining bar and first and second spaced apart, parallel arms extending from the restraining bar for straddling the office equipment and telescopically engaging the first and second base arms, respectively, said restraining bar having an adjustable width;

one of said first clamping member arm and said first base arm having a plurality of longitudinally spaced teeth located along a portion of the length thereof, and a locking device associated with the other of said first clamping member arm and said first base arm having a pawl engaging said teeth and preventing the clamping member from being pulled apart from the first base section when the locking device is locked.

15. The anti-theft device according to claim 14 wherein each of said base section has a forward end and a rearward end, one of said base sections having an upwardly extending back peripheral wall located at the rearward end thereof for preventing backward horizontal movement of the office equipment component, the other of said base sections having an upwardly extending front peripheral wall located at the forward end thereof for preventing forward horizontal movement of the office equipment component.

16. The anti-theft device according to claim 15 wherein the forward end of the base section having the back peripheral wall is open such that a forward end of the office equipment component can extend beyond the forward end of the base section having the back peripheral wall, and the rearward end of the base section having the front peripheral wall is open such that a rearward end of the office equipment component can extend beyond the rearward end of the base section having the front peripheral wall.

17. The anti-theft device according to claim 16 wherein securing holes are provided through said first and second base sections for securing said sections to the support surface and said base sections each have base plates rectangular in shape and said securing holes are formed therethrough in locations inwardly offset from an outer edge of said base plates such that at least one of said securing holes in each base plate will be concealed when the office equipment component is located on said base plates.

18. The anti-theft device according to claim 14 wherein said restraining bar includes a locking bar telescopically received within a tubular member, one of said arms of said clamping member being connected to said tubular member, the other of said arms of said clamping member being connected to said locking bar.

19. The anti-theft device according to claim 18 including locking means associated with said tubular member and locking bar for preventing withdrawal of said locking bar from said tubular member when the first and second arms of the clamping member are located parallel to each other.

20. The anti-theft device according to claim 14 wherein said pawl is spring loaded to permit clamping member and said first base section to be telescoped together while preventing them from being pulled apart when the lock device is locked.

* * * * *